US008302437B2

(12) United States Patent
Fang

(10) Patent No.: US 8,302,437 B2
(45) Date of Patent: Nov. 6, 2012

(54) LOCKING ASSEMBLY FOR A DOOR

(75) Inventor: Guan-Chen Fang, Tianjin (CN)

(73) Assignee: Eversafety Precision Industry (Tainjin) Co., Ltd., Tianjin (CN)

( * ) Notice: Subject to any disclaimer, the term of this patent is extended or adjusted under 35 U.S.C. 154(b) by 381 days.

(21) Appl. No.: 12/825,450

(22) Filed: Jun. 29, 2010

(65) Prior Publication Data

US 2011/0314876 A1 Dec. 29, 2011

(51) Int. Cl.
*E05B 13/10* (2006.01)
*E05B 3/00* (2006.01)

(52) U.S. Cl. ..... 70/224; 70/91; 70/107; 70/141

(58) Field of Classification Search ..... 70/91, 92, 70/103, 106–111, 134, 141, 224, DIG. 42; 292/21, 34–37, 40, 336.3
See application file for complete search history.

(56) References Cited

U.S. PATENT DOCUMENTS 4,052,092 A * 10/1977 Bergen ..... 292/172
4,109,494 A * 8/1978 Allemann ..... 70/107
5,077,992 A * 1/1992 Su ..... 70/107
5,611,227 A * 3/1997 Solovieff ..... 70/472
5,655,393 A * 8/1997 Kuo et al. ..... 70/107
6,257,030 B1 * 7/2001 Davis et al. ..... 70/107
6,564,596 B2 * 5/2003 Huang ..... 70/107
7,748,759 B2 * 7/2010 Chen et al. ..... 292/347
8,161,780 B1 * 4/2012 Huml ..... 70/107
2004/0107747 A1 * 6/2004 Chang ..... 70/107
2006/0043742 A1 * 3/2006 Huang et al. ..... 292/336.3
2009/0314042 A1 * 12/2009 Fan ..... 70/141

* cited by examiner

*Primary Examiner* — Christopher Boswell
(74) *Attorney, Agent, or Firm* — Alan Kamrath; Kamrath IP Lawfirm, PA

(57) ABSTRACT

A locking assembly for a door having an outer side, an inner side and a sidewall and has an exterior assembly, a cylinder and an interior assembly. The exterior assembly is mounted on the outer side of the door and has an outside mounting seat, a press-button, a transmitting device, a transmitting board, an engaging wheel and a rotating spindle. The cylinder is mounted in the exterior assembly and has a cylinder-transmitting panel. The multi-point latch is mounted in the sidewall of the door and is connected to the exterior assembly and the cylinder. The interior assembly is mounted on the inner side of the door, is connected to the exterior assembly and the cylinder and has an inside mounting seat, a operating handle, a switch, a linking device, a seat board, an inside reset spring and a switch mount.

7 Claims, 12 Drawing Sheets

LOCKING ASSEMBLY FOR A DOOR

BACKGROUND OF THE INVENTION

1. Field of the Invention

The present invention relates to a locking assembly, and more particularly to a locking assembly for a door that has a prolonged useful life and can be quickly unlocked.

2. Description of Related Art

A conventional locking assembly is securely mounted on a door to lock the door to prevent unauthorized access to a room. The conventional locking assembly has an exterior assembly, a multi-point latch and an interior assembly. The exterior assembly and the interior assembly are respectively mounted on opposite sides of the door and the multi-point latch is mounted on a sidewall of the door between the exterior assembly and the interior assembly. The exterior assembly has a press-button, a rotating spindle extended through the multi-point latch and connected to the interior assembly and an outside reset spring mounted in the exterior assembly. The interior assembly has an inner reset spring mounted in the interior assembly to press the rotating spindle of the exterior assembly. The multi-point latch has at least one latch bolt and a dead bolt. The at least one latch bolt and the dead bolt can be retracted into the multi-point latch to unlock the door.

When the press-button of the exterior assembly is pressed, the rotating spindle will rotate to move the multi-point latch to unlock the door and press the reset spring in the interior assembly at the same time. The reset springs are compressed at the same time by the rotating spindle when pressing the press-button and this will increase a force required to press the press-button and shorten useful life of the reset spring.

Furthermore, the at least one latch bolt and the dead bolt of the multi-point latch bar can not be retracted into the multi-point latch bar at the same time when the user wants to unlock the door from the interior assembly side, and this is inconvenient and may cause unnecessary delays in emergencies.

The invention provides a locking assembly that mitigates or obviates the aforementioned problems.

SUMMARY OF THE INVENTION

The main objective of the present invention is to provide a locking assembly for a door that has a prolonged useful life and can be quickly unlocked.

The locking assembly for a door having an outer side, an inner side and a sidewall in accordance with the present invention has an exterior assembly, a cylinder and an interior assembly. The exterior assembly is securely mounted on the outer side of the door and has an outside mounting seat, a press-button, a transmitting device, a transmitting board, an engaging wheel and a rotating spindle. The cylinder is mounted in the outside mounting seat of the exterior assembly and has a cylinder-transmitting panel. The interior assembly is securely mounted on the inner side of the door, is connected to the exterior assembly and the cylinder and has an inside mounting seat, an operating handle, a switch, a linking device, a seat board, an inside reset spring and a switch mount. Other objectives, advantages and novel features of the invention will become more apparent from the following detailed description when taken in conjunction with the accompanying drawings.

DETAILED DESCRIPTION OF THE PREFERRED EMBODIMENT

Figure 1:
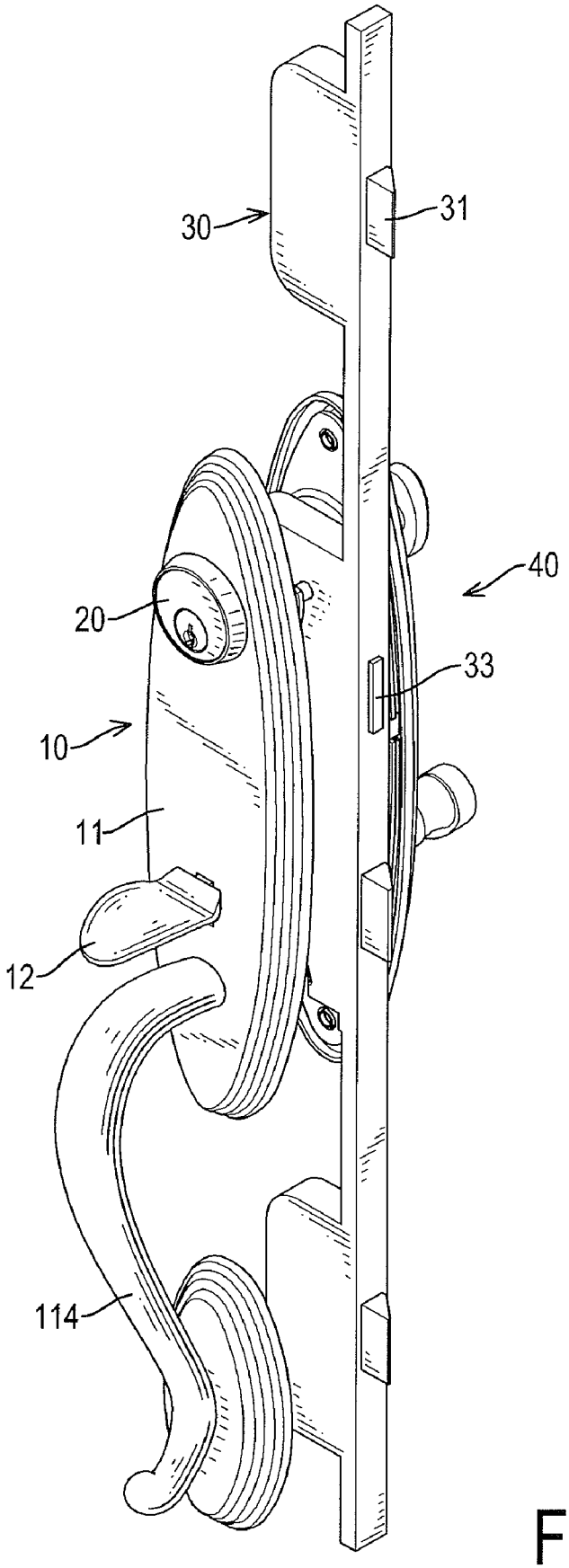
FIG. 1 is a perspective view of a locking assembly for a door in accordance with the present invention.
Figure 2A:
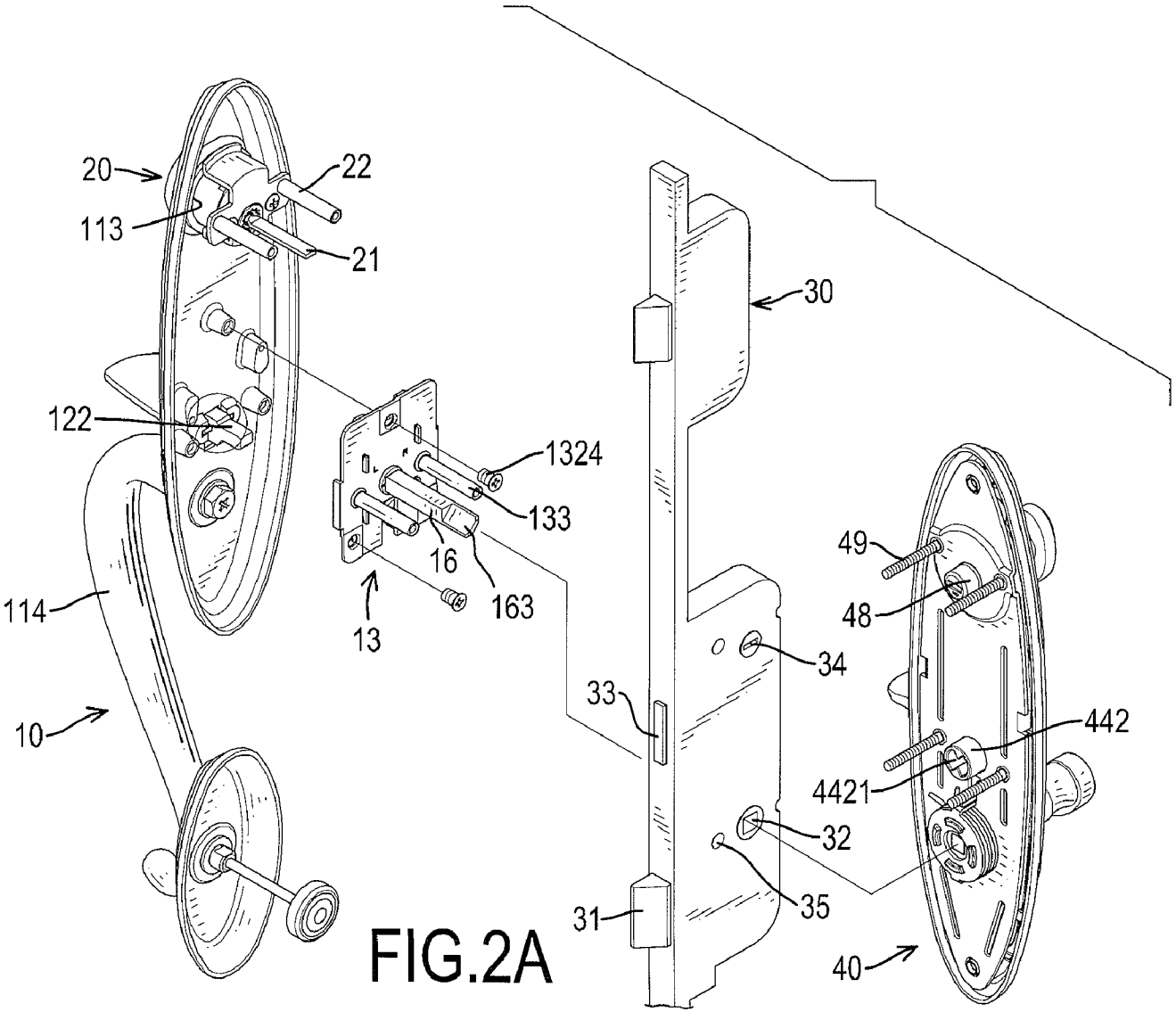
FIG. 2A is an exploded perspective view of an exterior assembly of the locking assembly in FIG. 1.
Figure 2B:
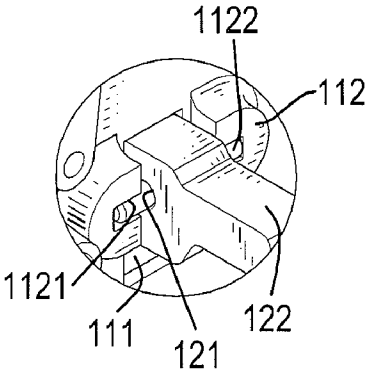
FIG. 2B is an enlarged perspective view of a press-button of the exterior assembly in FIG. 2A.
Figure 3:
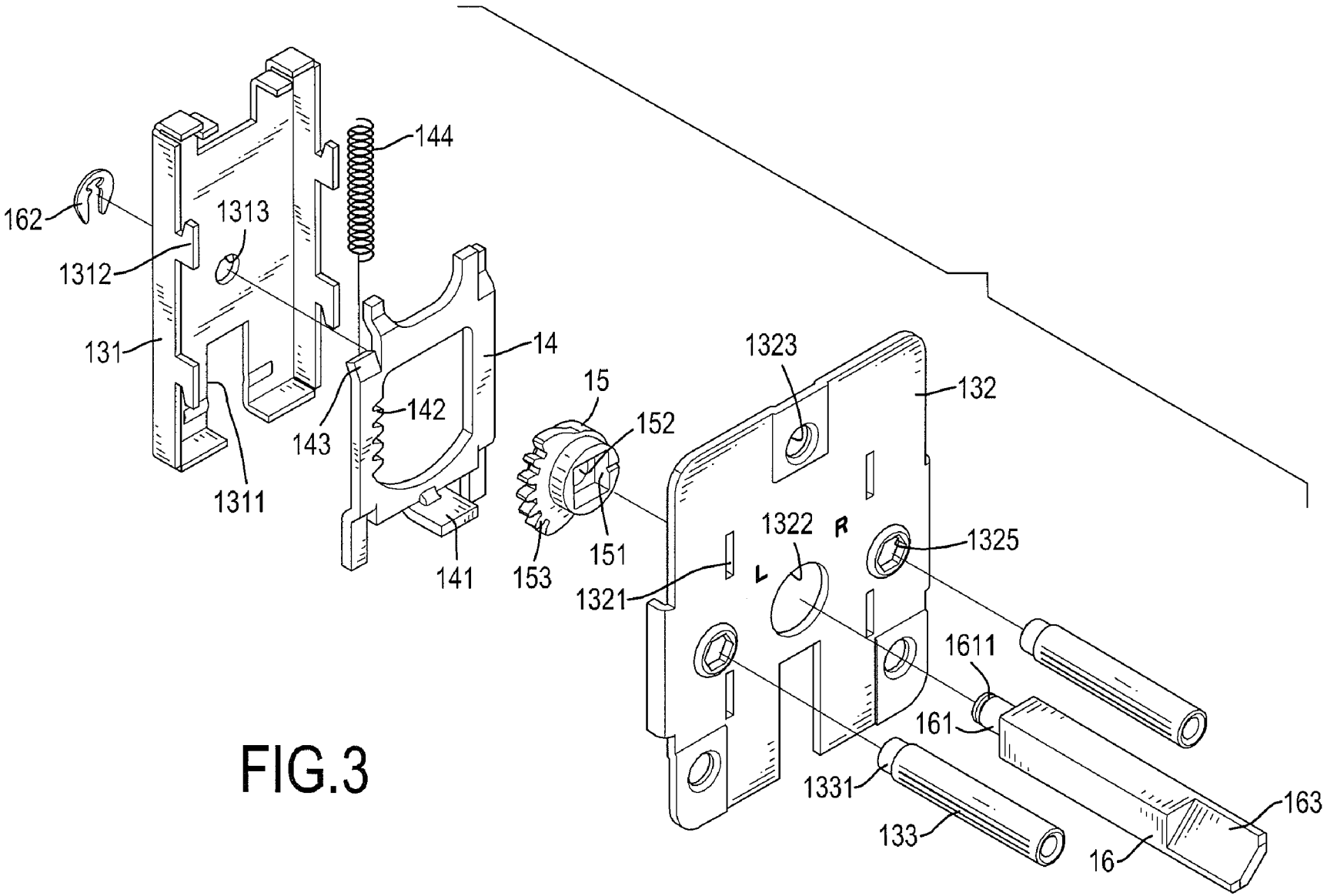
FIG. 3 is an enlarged exploded perspective view of the exterior assembly in FIG. 2.

With reference to FIGS. 1 to 6, a locking assembly in accordance with the present invention is mounted on a door having an outer side, an inner side and a sidewall, is connected to a multi-point latch (30) and comprises an exterior assembly (10), a cylinder (20) and an interior assembly (40). With reference to FIGS. 1 to 3, the exterior assembly (10) is securely mounted on the outer side of the door and has an outside mounting seat (11), a press-button (12), a transmitting device (13), a transmitting board (14), an engaging wheel (15) and a rotating spindle (16).

The outside mounting seat (11) is securely mounted on the outer side of the door and has an outer side, an inner side, an upper end, a lower end, a handle (114), a mounting hole (111), two mounting bases (112), a mounting pin (1122) and a cylinder hole (113). The inner side of the outside mounting seat (11) abuts with the outer side of the door. The handle (114) is mounted on the outer side of the outside mounting seat (11) near the lower end. The mounting hole (111) is square and is formed through the outside mounting seat (11) near the handle (114). With further reference to FIG. 2B, the mounting bases (112) are formed on and protrude from the inner side of the outside mounting seat (11) beside the mounting hole (111) and each mounting base (112) has a mounting recess (1121) facing the mounting hole (111). The mounting pin (1122) is mounted in the mounting recesses (1121) of the mounting bases (112). The cylinder hole (113) is formed through the outside mounting seat (11) near the upper end. The press-button (12) is pivotally connected to the outside mounting seat (11) in the mounting hole (111) and has an inner end, an outer end, a top side, a pin hole (121) and a driving surface (122). The inner end of the press-button (12) is inserted in the mounting hole (111) and extends out of the inner side of the outside mounting seat (11). The pin hole (121) is formed through the press-button (12) near the inner end and is mounted around the mounting pin (1122) of the outside mounting seat (11). The driving surface (122) is defined on the top side of the press-button (12) at the inner end.

The transmitting device (13) is mounted on the inner side of the outside mounting seat (11) and has a transmitting casing (131), a covering panel (132) and two lower supporting rods (133).

The transmitting casing (131) is rectangular, is mounted on the inner side of the outside mounting seat (11) and has a closed outer side, an open inner side, a top, a bottom, two opposite sidewalls, a width, a button through hole (1311), multiple holding claws (1312) and an outer spindle hole (1313). The closed outer side of the transmitting casing (131) is mounted on the inner side of the outside mounting seat (11) and covers the mounting recesses (1121) of the outside mounting seat (11) to hold the mounting pin (1122) between the mounting bases (112) and the transmitting casing (131). The button through hole (1311) is formed through the closed outer side and the bottom of the transmitting casing (131) and aligns with the mounting hole (111). The inner end of the press-button (12) extends out of the button through hole (1311) of the transmitting casing (131). The holding claws (1312) are respectively formed on and protrude from the opposite sidewalls of the transmitting casing (131) around the open inner side. The outer spindle hole (1313) is formed through the closed outer side of the transmitting casing (131) above the button through hole (1311) and has a diameter.

The covering panel (132) is detachably connected to the transmitting casing (131) to cover the open inner side of the transmitting casing (131) and has a width, a top, a bottom, multiple holding holes (1321), an inner spindle hole (1322), multiple fastener holes (1323), multiple fasteners (1324) and two positioning holes (1325). The width of the covering panel (132) is wider than the width of the transmitting casing (131). The inner end of the press-button (12) extends out the bottom of the covering panel (132). The holding holes (1321) are formed through the covering panel (132) and are respectively connected to the holding claws (1312) to hold the covering panel (132) securely with the transmitting casing (131). The inner spindle hole (1322) is formed through the covering panel (132), aligns with the outer spindle hole (1313) of the transmitting casing (131) and has a diameter larger than the diameter of the outer spindle hole (1313). The fastener holes (1323) are formed through the covering panel (132) near the top and the bottom. The fasteners (1324) are mounted through the fastener holes (1323) and are connected securely to the inner side of the outside mounting seat (11). The positioning holes (1325) are formed through the covering panel (132) beside the inner spindle hole (1322). The lower supporting rods (133) are connected to the covering panel (132) and each lower supporting rod (133) has a diameter, an outer end, an inner end and a positioning pin (1331). The positioning pins (133) are respectively formed on and protrude from the outer ends of the lower supporting rods (133), are respectively mounted in the positioning holes (1325) of the covering panel (132) and each positioning pin (133) has a diameter narrower than the diameter of the lower supporting rod (133).

The transmitting board (14) is mounted in the transmitting device (13) between the transmitting casing (131) and the covering panel (132) and has a top, a bottom, a middle, two sides, an abutting slab (141), a rack (142), a spring mount (143) and an outer reset spring (144). The abutting slab (141) is formed on and protrudes from the bottom of the transmitting board (14), extends out of the bottom of the covering panel (132) and abuts the driving surface (122) of the press-button (12). The rack (142) is formed in the transmitting board (14) near the middle and is parallel with the opposite sidewalls of the transmitting casing (131) near one of the sides of the transmitting board (14). The spring mount (143) is formed on the side of the transmitting board (14) that is adjacent to the rack (142) near the top of the transmitting board (14). The outside reset spring (144) is mounted between the transmitting casing (131) and the transmitting board (14) and has two ends. One of ends of the outside reset spring (144) abuts the top of the transmitting casing (131) and the other end of the outside reset spring (144) is mounted on the spring mount (143) of the transmitting board (14). The engaging wheel (15) is rotatably mounted in the transmitting board (14) between the transmitting casing (131) and the covering panel (132), engages the rack (142) of the transmitting board (14) and has an inner side, an outer side, a periphery, a spindle hole (151), a circular hole (152) and multiple engaging teeth (153). The inner side of the engaging wheel (15) is mounted in the inner spindle hole (1322) of the covering panel (132). The outer side of the engaging wheel (15) is mounted in the transmitting board (14). The spindle hole (151) is square, is formed in the inner side of the engaging wheel (15) and has a diameter. The circular hole (152) is formed in the outer side of the engaging wheel (15), communicates with the spindle hole (151) and has a diameter narrower than the diameter of the spindle hole (151). The engaging teeth (153) are formed on the periphery of the engaging wheel (15) near the outer side and engage the rack (142) of the transmitting board (14).

Figure 6:
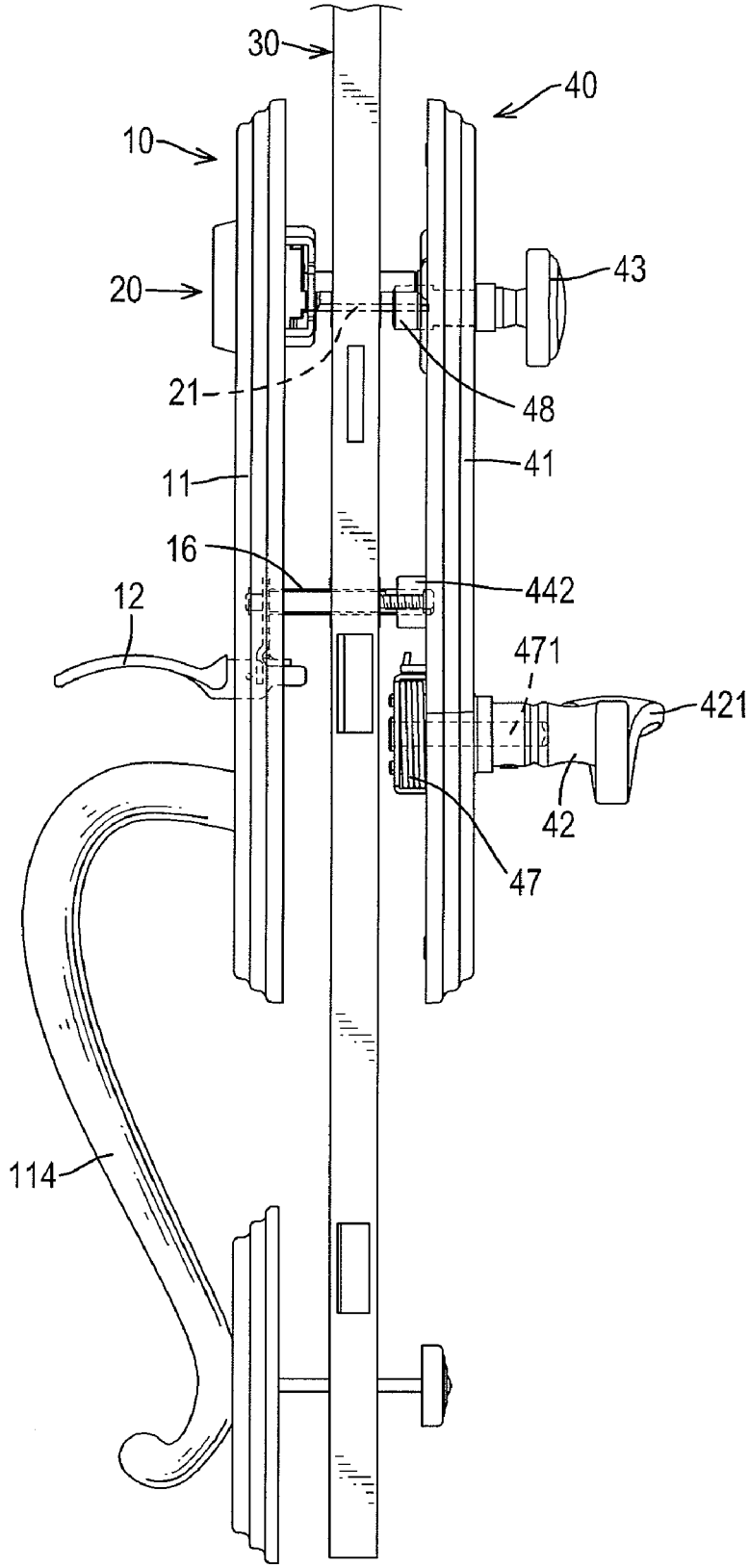
FIG. 6 is a side view of the locking assembly for a door in FIG. 1.
Figure 7:
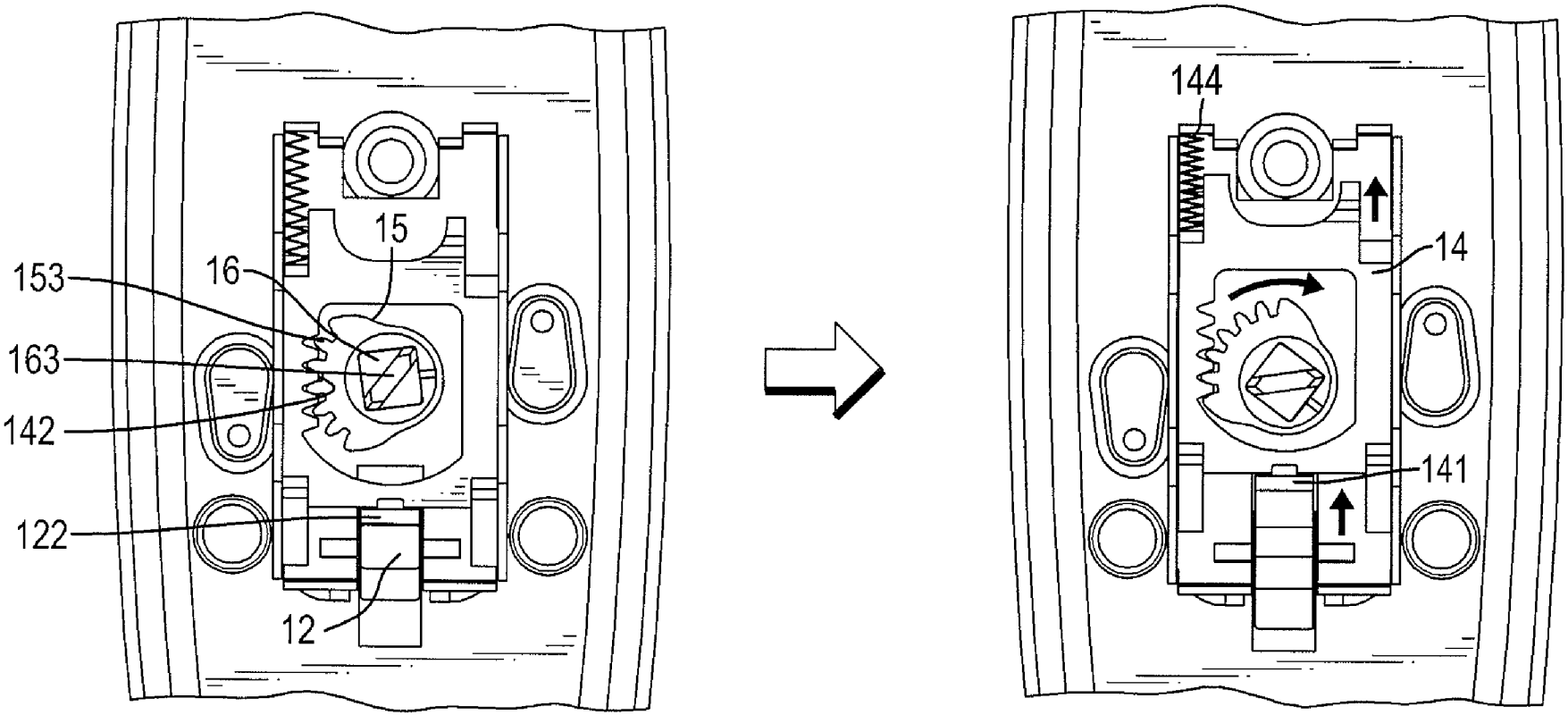
FIG. 7 are operational side views of the exterior assembly in FIG. 1 when the press-button is pressed downward.

The rotating spindle (16) is square, is connected to the engaging wheel (15) and has an outer end, an inner end, a circular rod (161), a retaining ring (162) and a tilting plate (163). The outer end of the rotating spindle (16) is securely mounted in the spindle hole (151) of the engaging wheel (15). The circular rod (161) is formed on the outer end of the rotating spindle (16), extends through the circular hole (152) of the engaging wheel (15) and the outer spindle hole (1313) of the transmitting casing (131) and has a free end, an external surface and an annular groove (1611). The free end of the circular rod (161) extends out of the closed outer side of the transmitting casing (131). The engaging groove (1611) is formed on the external surface of the circular rod (161) in the free end. The retaining ring (162) is mounted around the annular groove (1611) and abuts the closed outer side of the transmitting casing (131) to hold the rotating spindle (16) with the transmitting casing (131). The tilting plate (163) is formed on and protrudes from the inner end of the rotating spindle (16). With further reference to FIG. 2A, the cylinder (20) is mounted in the cylinder hole (113) of the outside mounting seat (11) of the exterior assembly (10) and has an outer side, an inner side, a keyway, a cylinder-transmitting panel (21) and two upper supporting rods (22). The keyway is formed in the outer side of the cylinder (20). With reference to FIG. 6, the cylinder-transmitting panel (21) is rotatably connected to the inner side of the cylinder (20) and extends through the door. The upper supporting rods (22) are connected to the inner side of the cylinder (20) beside the cylinder-transmitting panel (21) and extend through the door.

Figure 8:
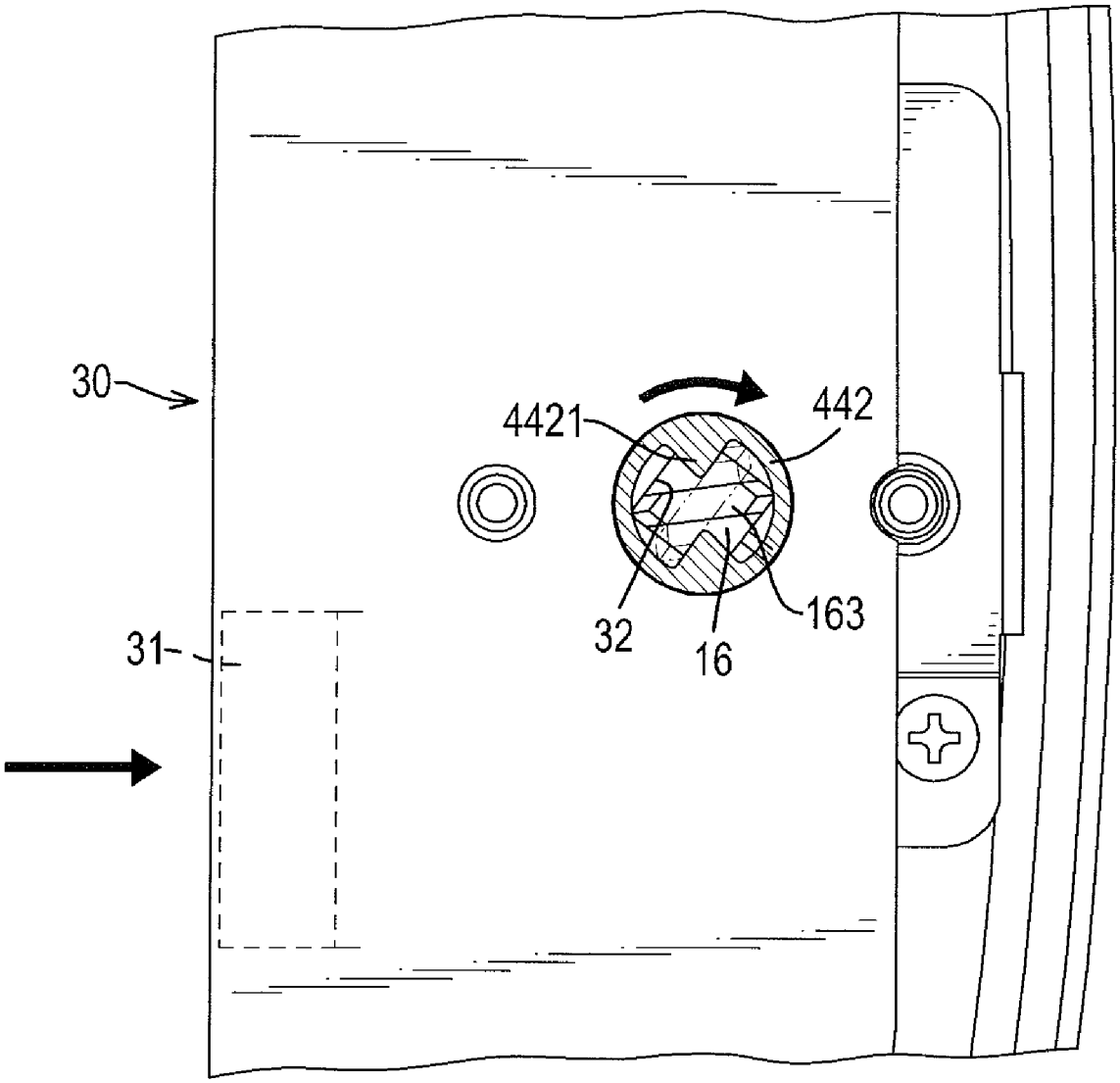
FIG. 8 is an operational side view in partial section of the multi-point latch bar in FIG. 1 when a rotating spindle of the exterior assembly is rotated in a clockwise direction.
Figure 10:
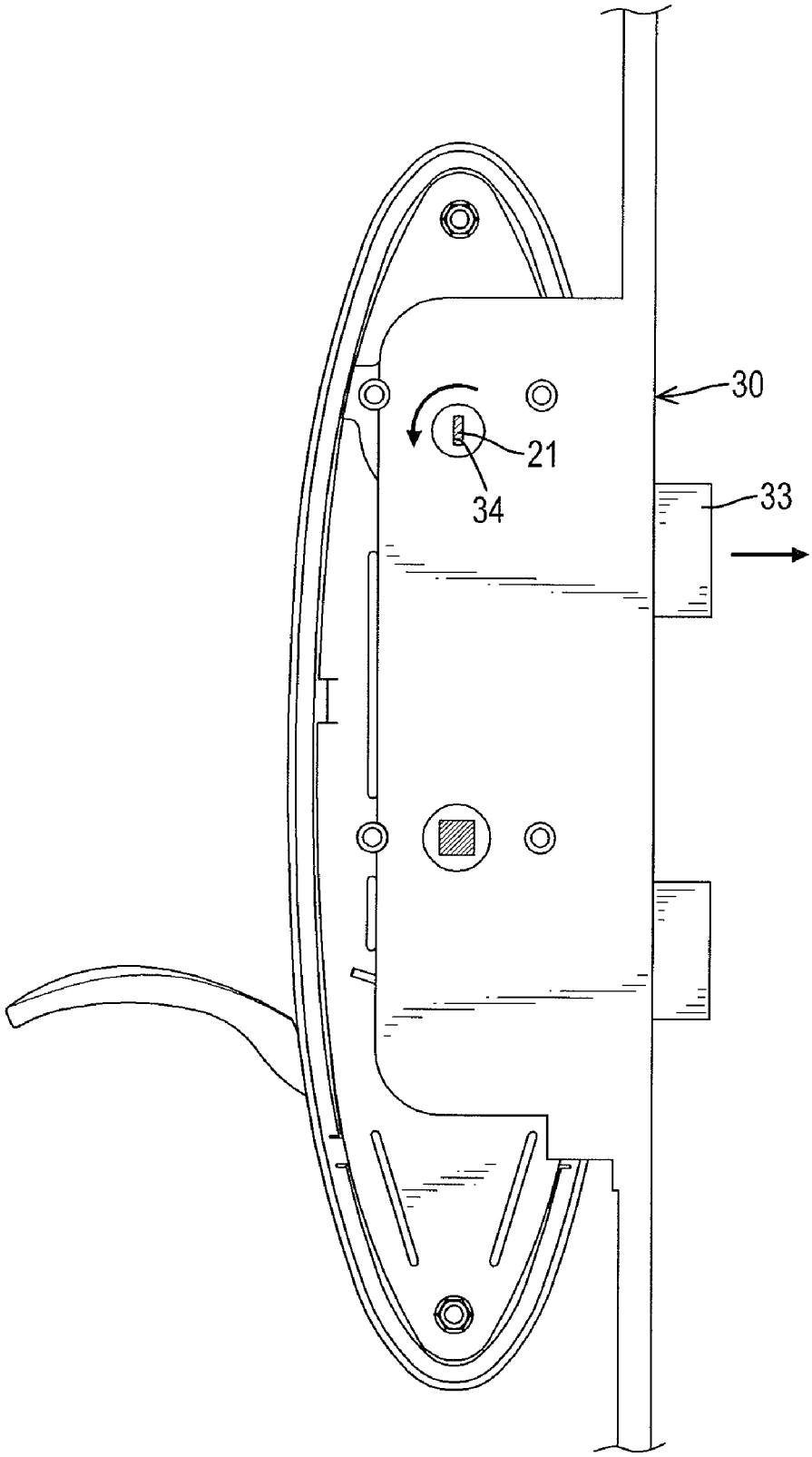
FIG. 10 is an operational side view of the multi-point latch bar in FIG. 1 when a cylinder-transmitting panel of the cylinder is rotated in a counterclockwise direction.
Figure 12:
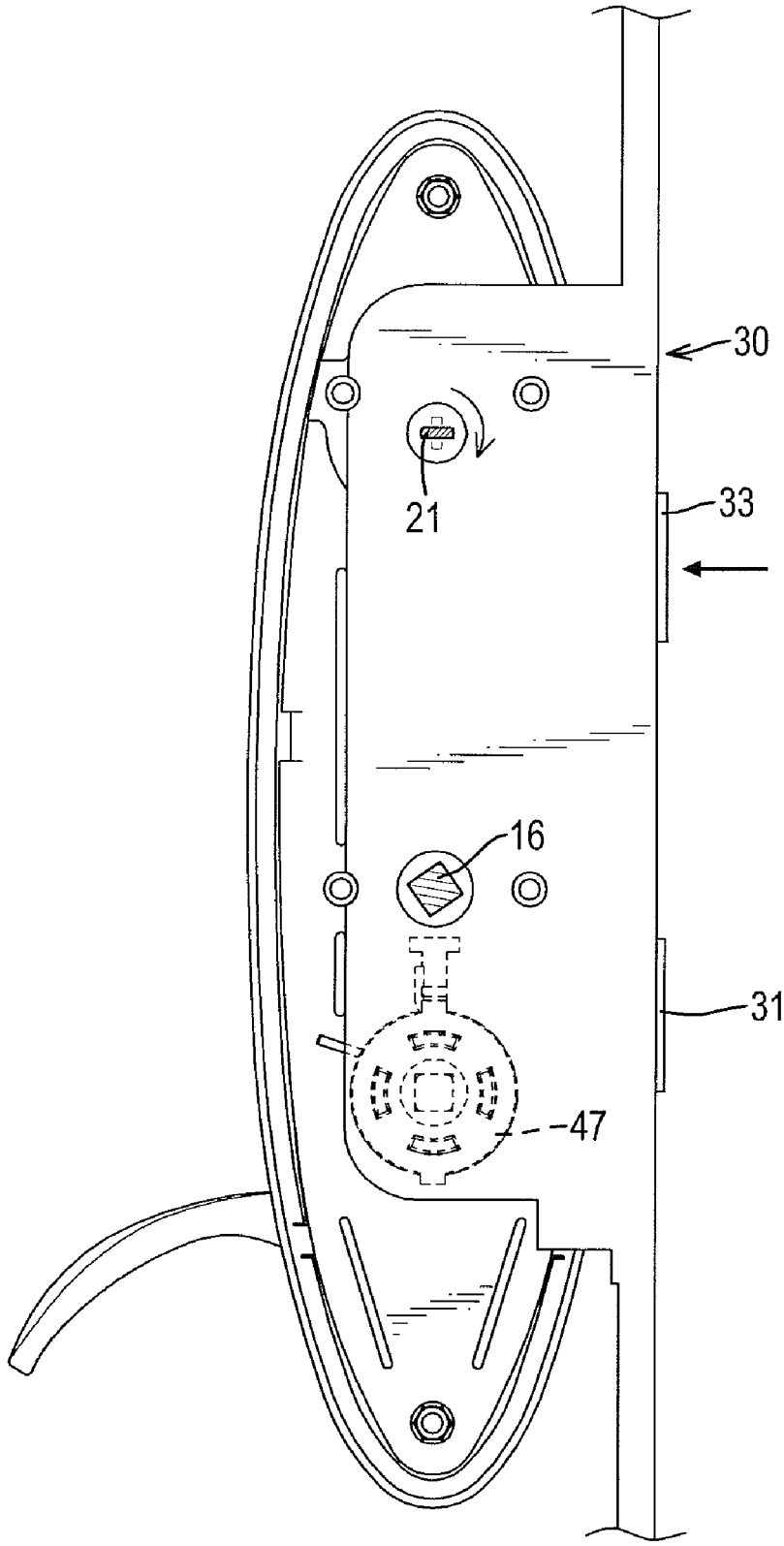
FIG. 12 is an operational side view of the multi-point latch bar in FIG. 1 shown the door is unlocked.

The multi-point latch (30) may be conventional, is securely mounted in the sidewall of the door, is connected to the exterior assembly (10) and the cylinder (20) and has a sidewall, a rear side, multiple latch bolts (31), a rotating hole (32), a dead bolt (33), a panel hole (34) and multiple rod holes (35). The latch bolts (31) are movably mounted on the sidewall of the multi-point latch (30), extend out of the sidewall of the door and can be retracted simultaneously into the multi-point latch (30) by a linking device. The rotating hole (32) is square, is formed through the multi-point latch (30) and is mounted around the rotating spindle (16). When the multi-point latch (30) is rotated with the rotating spindle (16) in the rotating hole (32), the latch bolts (31) will move into the multi-point latch (30) to unlock the door. The dead bolt (33) is movably mounted on the sidewall of the multi-point latch (30) between two of the latch bolts (31). The panel hole (34) is formed through the multi-point latch bar (30) and is mounted around the cylinder-transmitting panel (21) of the cylinder (20). When the panel hole (34) is rotated with the cylinder-transmitting panel (21) of the cylinder (20), the dead bolt (33) will move out of the multi-point latch (30) to lock the door. The rod holes (35) are separately formed through the multi-point latch bar (30) near the rotating hole (32) and the panel hole (34). With further reference to FIGS. 8, 10 and 12, one of the lower supporting rods (133) is mounted through the rod hole (35) that adjacent to the rotating hole (32) and the other lower supporting rod (133) abuts with the rear side of the multi-point latch bar (30). One of the upper supporting rods (22) is mounted through the rod hole (35) that adjacent to the panel hole (34) and the other upper supporting rod (22) abuts with the rear side of the multi-point latch bar (30).

Clockwise and counterclockwise directions described are in accordance with the drawings.

With reference to FIGS. 2 and 4 to 6, the interior assembly (40) is securely mounted on the inner side of the door, is connected to the exterior assembly (10), the cylinder (20) and the multi-point latch (30) and has an outer side, an inner side, an inside mounting seat (41), an operating handle (42), a switch (43), a linking device (44), a middle board (45), a seat board (46), an inside reset spring (47), a switch mount (48) and multiple fastening bolts (49). The inside mounting seat (41) is securely mounted on the inner side of the door and has an outer side, an inner side, a top end, a bottom end, a handle hole (411), a switch hole (412) and a positioning stub (413). The outer side of the inside mounting seat (41) is mounted on the inner side of the door. The handle hole (411) is formed through the inside mounting seat (41) near the bottom end. The switch hole (412) is formed through the inside mounting seat (41) near the top end and aligns with the cylinder-transmitting panel (21) of the cylinder (20). The positioning stub (413) is formed on and protrudes from the outer side of the inside mounting seat (41) above the handle hole (411) and aligns with the rotating spindle (16) of the exterior assembly (10). The operating handle (42) is rotatably connected to the inside mounting seat (41) in the holding hole (411) and has an external surface, a mounting end, an extending end, an operating stem (421) and a shaft hole (422). The mounting end of the operating handle (42) is rotatably mounted in the handle hole (411) of the inside mounting seat (41). The extending end of the operating handle (42) extends out of the inner side of the inside mounting seat (41). The operating stem (421) is formed on and protrudes from the external surface of the operating handle (42) near the extending end. The shaft hole (422) is square and is formed in the mounting end of the operating handle (42).

The switch (43) is rotatably connected to the inside mounting seat (41) in the switch hole (412) and has a mounting end, an extending end and a connecting post (431). The mounting end of the switch (43) is mounted through the switch hole (412) and extends out of the outer side of the inside mounting seat (41). The extending end of the switch (43) extends out of the inner side of the inside mounting seat (41). The connecting post (431) is noncircular in cross section and is formed on and protrudes from the mounting end of the switch (43). The linking device (44) is mounted on the outer side of the inside mounting seat (41) and has a lower rotating button (441), two connecting beams (443), an orientating shaft (442), two limiting beams (448), a rail board (446) and a connecting board (444).

The lower rotating button (441) aligns with the handle hole (411) of the inside mounting seat (41) and has an outer side, an inner side, an external surface, a location shaft (4412), a driving square-hole (4411) and two lower connecting arms (4413). The inner side of the lower rotating button (441) abuts the outer side of the inside mounting seat (41). The location shaft (4412) is formed on and protrudes from the outer side of the lower rotating button (441). The driving square-hole (4411) is formed through the location shaft (4412) and the sides of the lower rotating button (441) and aligns with the handle hole (411) of the inside mounting seat (41). The lower connecting arms (4413) are formed on and protrude from the external surface of the lower rotating button (441) and each connecting arm (4413) has a free end.

The connecting beams (443) are pivotally connected to the lower rotating button (441) and each connecting beam (443) has a lower end and an upper end. The lower ends of the connecting beams (443) are respectively and pivotally connected to the free ends of the lower connecting arms (4413) of the lower rotating button (441).

The orientating shaft (442) is pivotally connected to the connecting beams (443) above the lower rotating button (441), is rotatably mounted on the positioning stub (413) of the inside mounting seat (41) and has an inner side, an outer side, an external surface, two engaging holes (4421) and two linking arms (4422). The inner side of the orientating shaft (442) is rotatably mounted around the positioning stub (413). The engaging holes (4421) are formed in the outer side of the orientating shaft (442), communicate with each other and selectively engage the tilting plate (163) of the rotating spindle (16). The linking arms (4422) are formed on and protrude from the external surface of the orientating shaft (442) and are respectively and pivotally connected to the upper ends of the connecting beams (443).

The limiting beams (448) are pivotally connected to the orientating shaft (442) and each limiting beams (448) has a lower end, an upper end and a lower wheel (447). The lower ends of the limiting beams (448) are pivotally connected to the orientating shaft (442). The lower wheels (447) are respectively and rotatably connected to the upper ends of the limiting beams (448). The rail board (446) is connected to the limiting beams (448) and has a lower end, an upper end, two elongated grooves (4461) and an upper wheel (445). The elongated grooves (4461) are formed through the rail board (446) near the lower end and the lower wheels (447) of the limiting beams (448) are respectively and rotatably mounted in the elongated grooves (4461). The upper wheel (445) is rotatably connected to the upper end of the rail board (446). The connecting board (444) is connected to the connecting post (431) of the switch (43), is connected to the rail board (446) and has a post hole (4441) and a C-shaped groove (4442). The post hole (4441) is noncircular, is formed through the connecting board (444) and is securely mounted around the connecting post (431) of the switch (43). The C-shaped groove (4442) is formed through the connecting board (444). The upper wheel (445) of the rail board (446) is rotatably mounted in the C-shaped groove (4442) of the connecting board (444).

The middle board (45) is connected to the outer side of the inside mounting seat (41) to cover the linking device (44) between the inside mounting seat (41) and the middle board (45) and has a length, a lower end, an upper end, a lower guiding hole (451), a middle guiding hole (452) and an upper guiding hole (453). The lower guiding hole (451) is formed through the middle board (45) near the lower end and is mounted around the location shaft (4412) of the lower rotating button (441). The middle guiding hole (452) is formed through the middle board (45) and is mounted around the orientating shaft (442). The upper guiding hole (453) is formed through the middle board (45) near the upper end. The seat board (46) is securely connected to the inside mounting seat (41) to cover the middle board (45) and the linking device (44) between the inside mounting seat (41) and the seat board (46), abuts the supporting rods (133, 22) of the transmitting device (13) and the cylinder (20) and has a length, a lower end, an upper end, a spring hole (461), a middle locating hole (462), an upper locating hole (463) and multiple through holes (464). The length of the seat board (46) is longer than the length of the middle board (45). The spring hole (461) is formed through the seat board (46) near the lower end and aligns with the lower guiding hole (451) of the middle board (45). The middle locating hole (462) is formed through the seat board (46), aligns with the middle guiding hole (452) of the middle board (45) and is mounted around the orientating shaft (442). The upper locating hole (463) is formed through the seat board (46) and aligns with the upper guiding hole (453) of the middle board (45). The through holes (464) are formed through the seat board (46) and are respectively align with the supporting rods (133, 22) of the transmitting device (13) and the cylinder (20). The inside reset spring (47) is connected to the seat board (46) in the spring hole (461) and has a center and a driving shaft (471). The driving shaft (471) is square, is mounted through the center of the inside reset spring (47) and the driving square-hole (4411) of the lower rotating button (441) and is securely connected to the shaft hole (422) of the operating handle (42). The switch mount (48) is rotatably mounted between the upper guiding hole (453) of the middle board (45) and the upper locating hole (463) of the seat board (46) and has an outer end and an inner end. The outer end of the switch mount (48) is mounted around the cylinder-transmitting panel (21) of the cylinder (20). The inner end of the switch mount (48) is mounted around the connecting post (431) of the switch (43). When a user rotates the switch (43), the switch mount (48) and the cylinder-transmitting panel (21) will be rotated with the switch (43) in the same direction.

The fastening bolts (49) are mounted through the through holes (464) of the seat board (46) and are respectively and securely connected to the supporting rods (133, 22) of the transmitting device (13) and the cylinder (20) to hold the interior assembly (40) with the multi-point latch bar (30), the cylinder (20) and the exterior assembly (10).

With reference to FIGS. 2 and 6, the multi-point latch (30) is mounted in the sidewall of the door and the exterior assembly (10) and the interior assembly (40) are respectively mounted on the outer side and the inner side of the door. The latch bolts (31) can be retracted into the multi-point latch (30) when the rotating hole (32) is rotated with the rotating spindle (16) so as to unlock the door. A key can be inserted into the keyway of the cylinder (20) to lock the door by the cylinder-transmitting panel (21) rotating the panel hole (34) in clockwise direction to allow the dead bolt (33) moving out of the sidewall of the multi-point latch bar (30).

The rotating spindle (16) can be rotated relative to the multi-point latch (30) to unlock the door by pressing the press-button (12) of the exterior assembly (10) or pressing the operating stem (421) of the operating handle (42). In addition, when pressing the operating stem (421) of the operating handle (42), the motion of the linking device (44) can make the cylinder-transmitting panel (21) rotating in a counterclockwise to allow the dead bolt (34) retracting into the multi-point latch (30) to unlock the door.

With reference to FIGS. 2, 3, 7 and 8, when the user presses the press-button (12) of the exterior assembly (10), the driving surface (122) on the inner end of the press-button (12) will abut the abutting slab (141) to push the transmitting board (14) to move upward relative to the engaging wheel (15). As the transmitting board (14) moves upward with the inner end of the press-button (12), the engaging wheel (15) will rotate in a clockwise direction with the engagement between the rack (142) and the engaging teeth (153). Then, the rotating spindle (16) connected to the spindle hole (151) will be rotated by the engaging wheel (15) to let the latch bolts (31) retract into the multi-point latch (30) and unlock the door. When the user releases the press-button (12), the press-button (12) and the engaging wheel (15) can be returned to the original position by the outside reset spring (144) pushing the transmitting board (14) to move back the original location.

Figure 5:
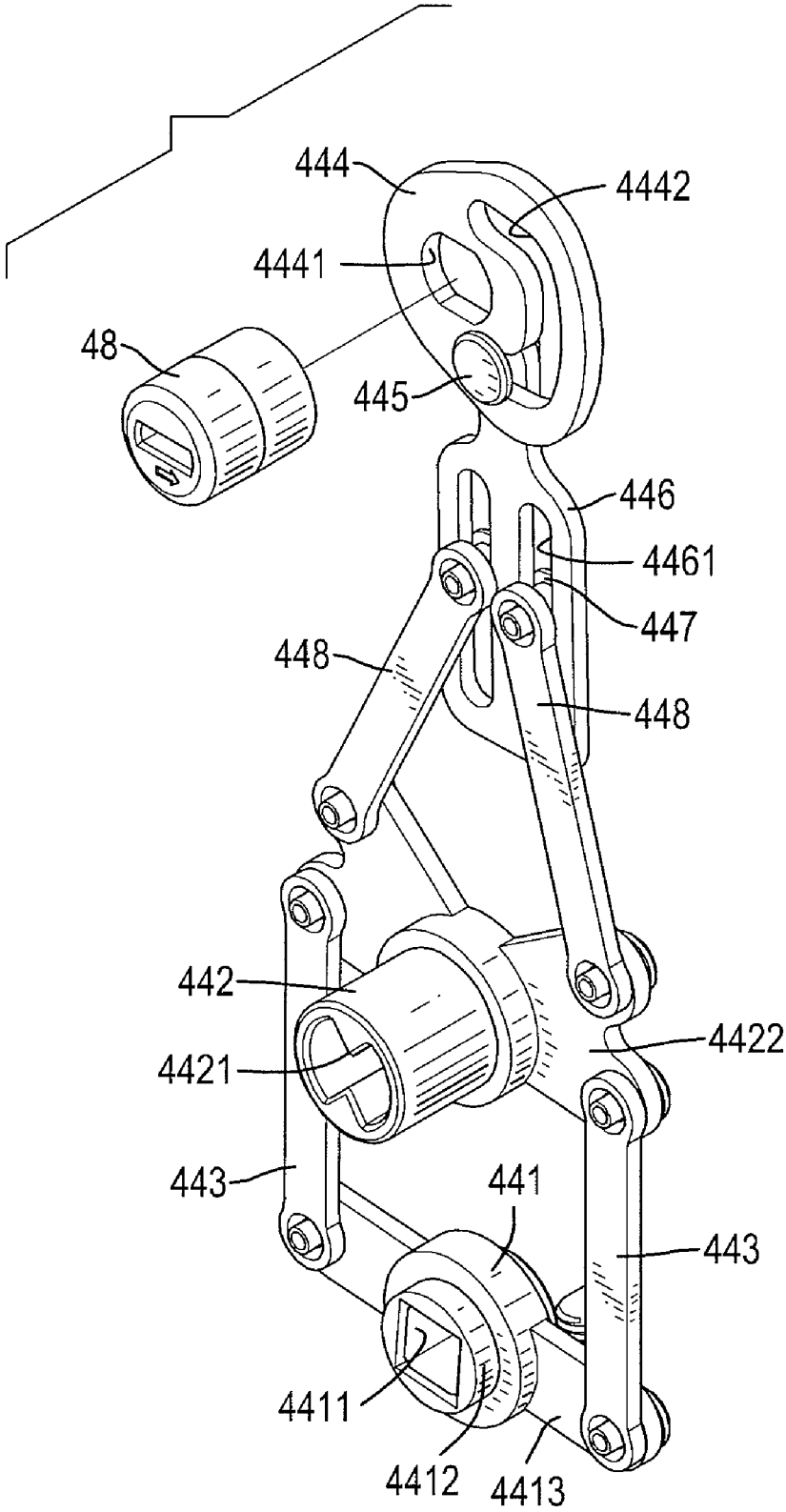
FIG. 5 is an enlarged, partially exploded perspective view of a linking device of the interior assembly in FIG. 4.
Figure 9:
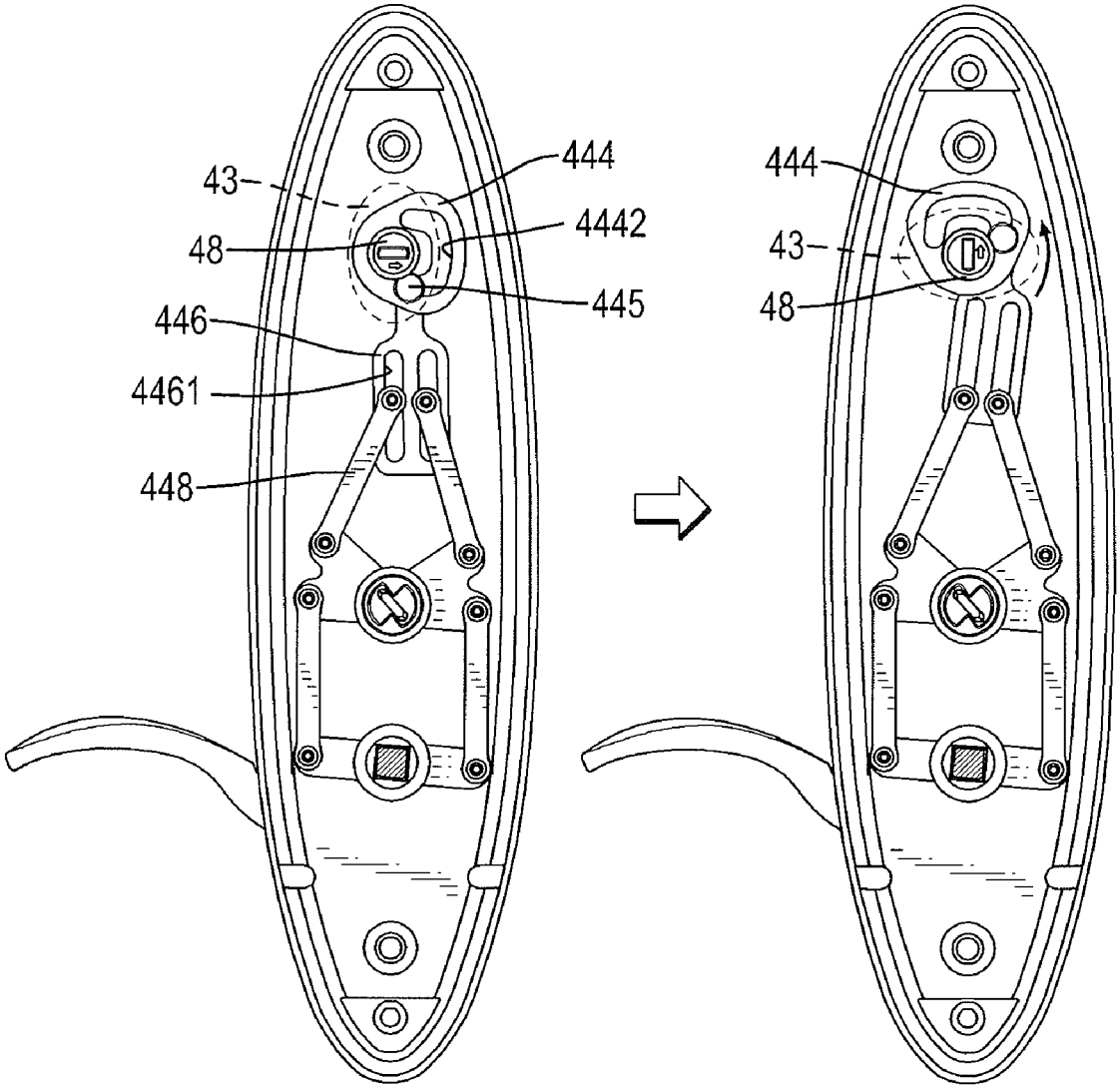
FIG. 9 are operational side views of the interior assembly in FIG. 1 when a switch of the interior assembly is rotated.

With reference to FIGS. 3, 5 and 9, during the operating process of unlocking the door above-mentioned, the rotating spindle (16) is rotated in a clockwise direction, the tilting plate (163) will idle in the engaging holes (4421) of the orientating shaft (442). Then, the driving shaft (471) will not rotate with the linking device (44) due to the tilting plate (163) of the rotating spindle (16) being rotated in the engaging holes (4421) of the orientating shaft (442). Therefore, this can prevent the inside reset spring (47) of the interior assembly (40) from being pressed when the rotating spindle (16) is rotated by the press-button (12). Consequently, useful life of the inside reset spring (31) of the interior assembly (40) will be prolonged.

When the switch (43) is rotated in a clockwise direction at an angle of 90° as shown in FIGS. 5, 9 and 10, the linking device (44) and the switch mount (48) will rotate with the switch (43) to allow the cylinder-transmitting panel (21) rotating with the switch mount (48). Then, the panel hole (34) can be rotated with the cylinder-transmitting panel (21) to allow the dead bolt (33) to move out of the sidewall of the multi-point latch bar (30) to lock the door. During the operating process of locking the door above-mentioned, the upper wheel (445) of the linking device (44) will rotate with the connecting board (444) by the C-shaped groove (4442) to pull the rail board (446) moving upward relative to the limiting beams (448). Then, the lower wheels (447) of the limiting beams (448) will rotate to the lower end of the rail board (446).

Figure 4:
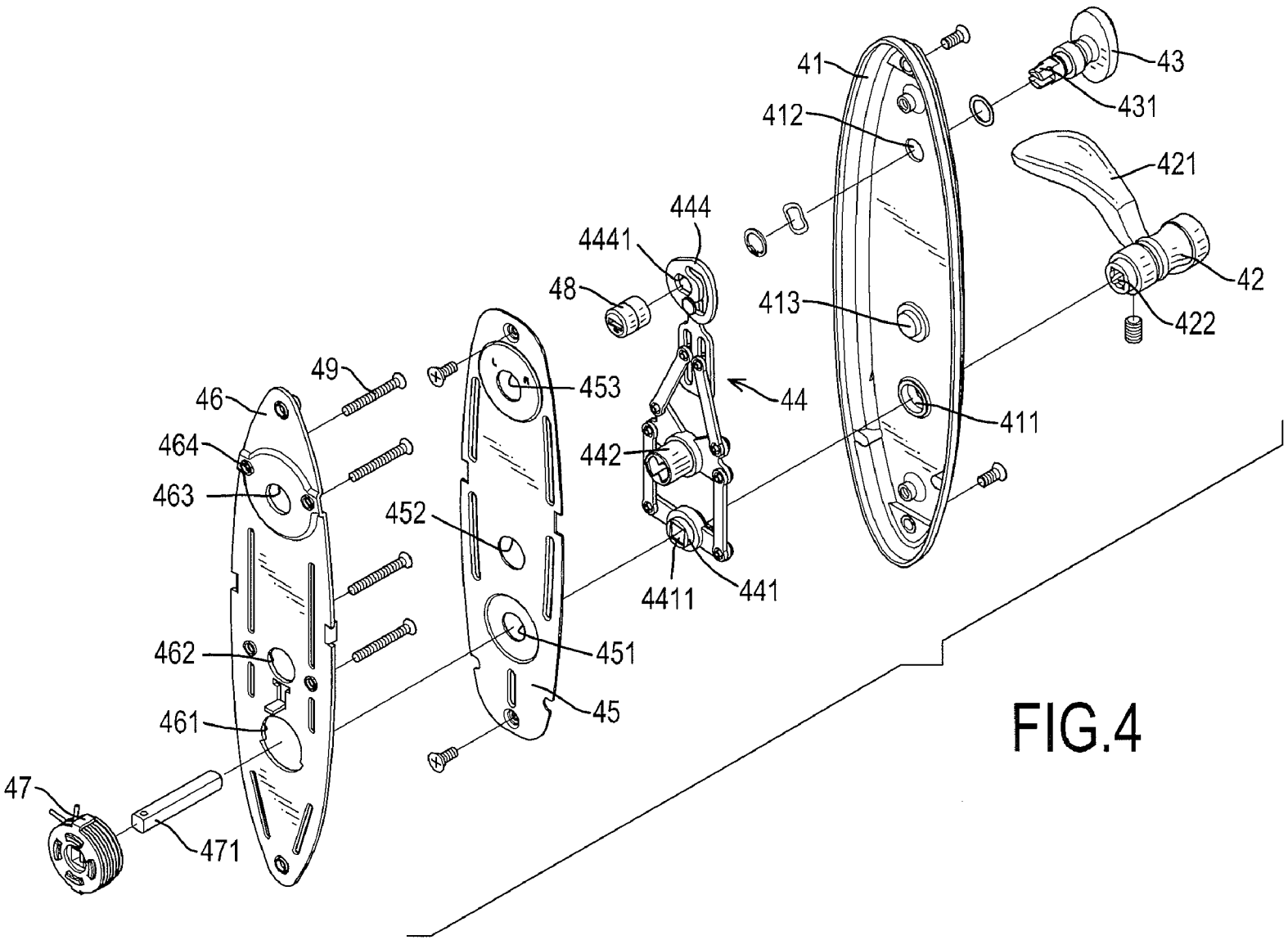
FIG. 4 is an enlarged exploded perspective view of an interior assembly of the locking assembly in FIG. 1.
Figure 11:
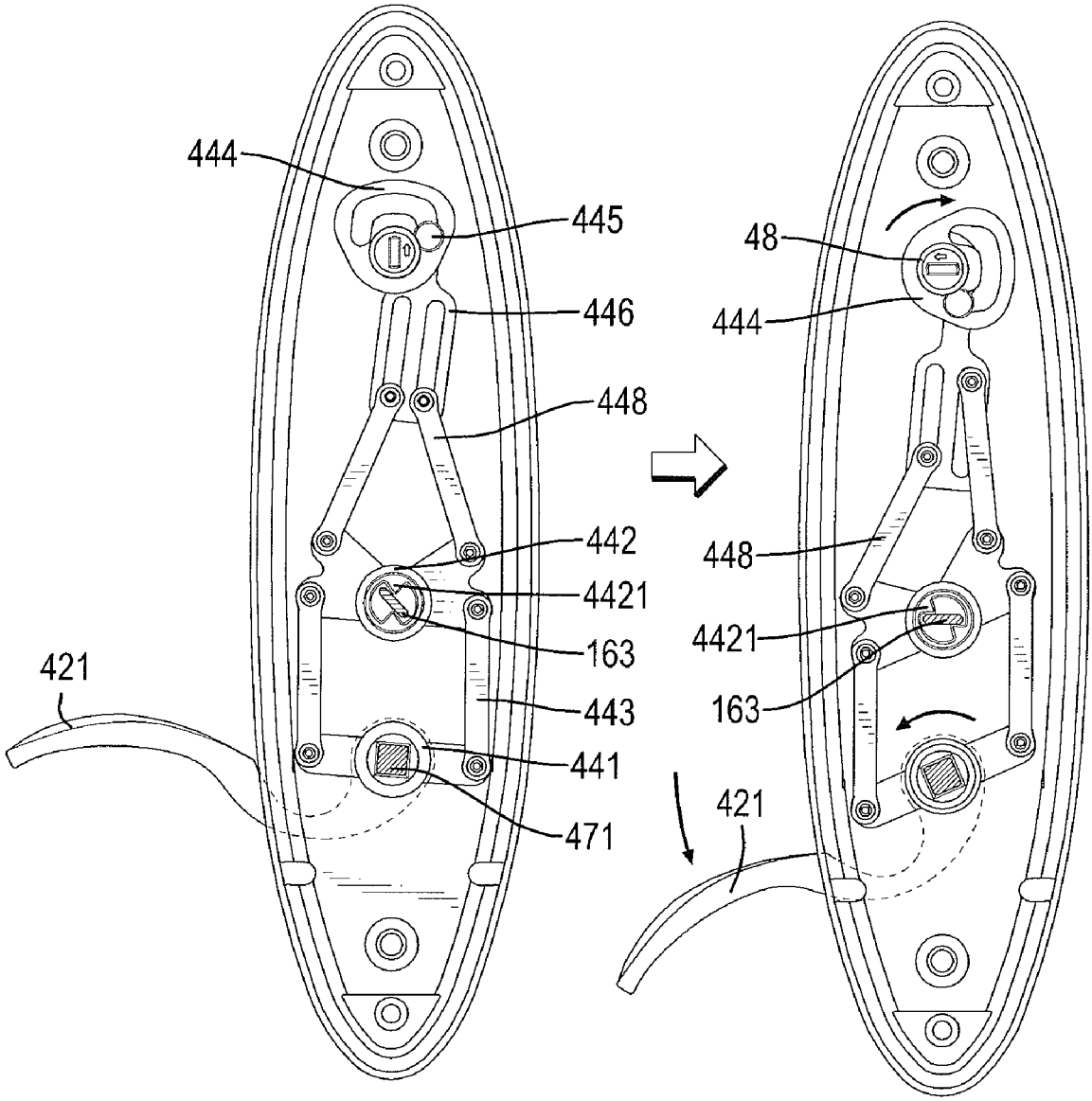
FIG. 11 are operational side views of the interior assembly in FIG. 1 when an operating handle of the interior assembly is rotated.

With further reference to FIGS. 4, 11 and 12, when pressing the operating stem (421) of the operating handle (42) to resist elastic force of the inside reset spring (47), the driving shaft (471) will be rotated in a clockwise direction with the shaft hole (442) of the operating handle (42) being securely mounted around the square driving shaft (471). The lower rotating button (441) will be rotated with the driving shaft (471) and the connecting beams (443) will be moved with the lower rotating button (441). Then, the orientating shaft (442) will be rotated with the movement of the connecting beams (443) and one of the limiting beams (448) will move downward relative to the rail board (446) and the other limiting beam (448) will move upward relative to the rail board (446). The connecting board (444) will be rotated in a counterclockwise direction due to the upper wheel (445) of the rail board (446) pulling the connecting board (444). As the connecting board (444) rotates with the rail board (446), the switch mount (48) will rotate with the connecting board (444) in a counterclockwise direction.

When the orientating shaft (442) is rotated in a clockwise direction, the orientating shaft (442) will rotate the tilting plate (163) by the engagement between the engaging holes (4421) and the tilting plate (163). The latch bolts (31) can be retracted into the multi-point latch (30) when the rotating spindle (16) is rotated with the tilting plate (163). In addition, the dead bolt (33) can be retracted into the multi-point latch (30) when the switch mount (48) is rotated with the switch (43) in a counterclockwise direction. Consequently, the latch bolts (31) and the dead bolt (33) can be retracted into the multi-point latch bar (30) at the same time as the operating stem (421) of the operating handle (42) is pressed downward. Then, user can unlock the door quickly in an urgent situation by pressing the operating stem (421) of the operating handle (42). Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A locking assembly for a door having an outer side, an inner side and a sidewall and the locking assembly comprising an exterior assembly adapted to securely mount on the outer side of the door and having an outside mounting seat adapted to securely mount on the outer side of the door and having an outer side;

an inner side adapted to abut with the outer side of the door;

an upper end;

a lower end;

a mounting hole being square and formed through the outside mounting seat near the lower end; and a cylinder hole formed through the outside mounting seat near the upper end;

a press-button pivotally connected to the outside mounting seat in the mounting hole and having an inner end inserted in the mounting hole and extending out of the inner side of the outside mounting seat;

an outer end;

a top side; and a driving surface defined on the top side of the press-button at the inner end;

a transmitting device mounted on the inner side of the outside mounting seat and having a bottom;

a closed outer side;

an inner side;

a button through hole formed through the outer side and the bottom of the transmitting device and aligning with the mounting hole, wherein the inner end of the press-button extends out of the button through hole of the transmitting casing;

an outer spindle hole formed through the closed outer side of the transmitting device above the button through hole and having a diameter; and an inner spindle hole formed through the inner side of the transmitting device, aligning with the outer spindle hole and having a diameter larger than the diameter of the outer spindle hole;

a transmitting board mounted in the transmitting device and having a top;

a bottom;

a middle;

two sides;

an abutting slab formed on and protruding from the bottom of the transmitting board, extending out of the bottom of the covering panel and abutting the driving surface of the press-button;

a rack formed in the transmitting board near the middle and parallel with the opposite sidewalls of the transmitting casing near one of the sides of the transmitting board; and an outer reset spring mounted between the transmitting device and the transmitting board;

an engaging wheel rotatably mounted in the transmitting board, engaging the rack of the transmitting board and having an inner side;

an outer side mounted in the transmitting board;

a periphery;

a spindle hole being square, formed in the inner side of the engaging wheel and having a diameter;

a circular hole formed in the outer side of the engaging wheel, communicating with the spindle hole and having a diameter narrower than the diameter of the spindle hole; and multiple engaging teeth formed on the periphery of the engaging wheel near the outer side and engaging the rack of the transmitting board; and a rotating spindle being square, connected to the engaging wheel and having an outer end securely mounted in the spindle hole of the engaging wheel;

an inner end;

a circular rod formed on the outer end of the rotating spindle, extending through the circular hole of the engaging wheel and the outer spindle hole of the transmitting device and having a free end extending out of the closed outer side of the transmitting device;

an external surface; and an annular groove formed on the external surface of the circular rod in the free end;

a retaining ring mounted around the annular groove and abutting the closed outer side of the transmitting casing to hold the rotating spindle with the transmitting casing; and a tilting plate formed on and protruding from the inner end of the rotating spindle;

a cylinder mounted in the cylinder hole of the outside mounting seat of the exterior assembly and having an outer side;

an inner side;

a keyway formed in the outer side of the cylinder; and a cylinder-transmitting panel rotatably connected to the inner side of the cylinder and extending through the door; and an interior assembly adapted to securely mount on the inner side of the door, connected to the exterior assembly and the cylinder and having an outer side;

an inner side;

an inside mounting seat adapted to securely mount on the inner side of the door and having an outer side adapted to mount on the inner side of the door;

an inner side;

a top end;

a bottom end;

a handle hole formed through the inside mounting seat near the bottom end;

a switch hole formed through the inside mounting seat near the top end and aligning with the cylinder-transmitting panel of the cylinder; and a positioning stub formed on and protruding from the outer side of the inside mounting seat above the handle hole and aligning with the rotating spindle of the exterior assembly;

an operating handle rotatably connected to the inside mounting seat in the holding hole and having a mounting end rotatably mounted in the handle hole of the inside mounting seat;

an extending end extending out of the inner side of the inside mounting seat; and a shaft hole being square and formed in the mounting end of the operating handle;

a switch rotatably connected to the inside mounting seat in the switch hole and having a mounting end mounted through the switch hole and extending out of the outer side of the inside mounting seat;

an extending end extending out of the inner side of the inside mounting seat; and a connecting post formed on and protruding from the mounting end of the switch;

a linking device mounted on the outer side of the inside mounting seat and having a lower rotating button aligning with the handle hole of the inside mounting seat and having an outer side;

an inner side abutting the outer side of the inside mounting seat;

an external surface;

a driving square-hole formed through the sides of the lower rotating button and aligning with the handle hole of the inside mounting seat; and two lower connecting arms formed on and protruding from the external surface of the lower rotating button and each connecting arm having a free end;

two connecting beams pivotally connected to the loser rotating button and each connecting beam having a lower end pivotally connected to the free end of one of the lower connecting arms of the lower rotating button; and an upper end;

an orientating shaft pivotally connected to the connecting beams above the lower rotating button, rotatably mounted on the positioning stub of the inside mounting seat and having an inner side rotatably mounted around the positioning stub;

an outer side;

an external surface;

two engaging holes formed in the outer side of the orientating shaft, communicating with each other and selectively engaging the tilting plate of the rotating spindle; and two linking arms formed on and protruding from the external surface of the orientating shaft and respectively and pivotally connected to the upper ends of the connecting beams;

two limiting beams pivotally connected to the orientating shaft and each limiting beams having a lower end pivotally connected to the orientating shaft;

an upper end; and a lower wheel rotatably connected to the upper end of the limiting beam;

a rail board connected to the limiting beams and having a lower end;

an upper end;

two elongated grooves formed through the rail board near the lower end, wherein the lower wheels of the limiting beams are respectively and rotatably mounted in the elongated grooves; and an upper wheel rotatably connected to the upper end of the rail board; and a connecting board connected to the connecting post of the switch, connected to the rail board and having a post hole formed through the connecting board and securely mounted around the connecting post of the switch; and a C-shaped groove formed through the connecting board, wherein the upper wheel of the rail board is rotatably mounted in the C-shaped groove of the connecting board;

a seat board securely connected to the inside mounting seat to cover the linking device between the inside mounting seat and the seat board and having a lower end;

an upper end;

a spring hole formed through the seat board near the lower end;

a middle locating hole formed through the seat board and mounted around the orientating shaft; and an upper locating hole formed through the seat board;

an inside reset spring connected to the seat board in the spring hole and having a center; and a driving shaft being square, mounted through the center of the inside reset spring and the driving square-hole of the lower rotating button and securely connected to the shaft hole of the operating handle; and a switch mount rotatably mounted in the upper locating hole of the seat board and having an outer end mounted around the cylinder-transmitting panel of the cylinder; and an inner end mounted around the connecting post of the switch.

2. The locking assembly as claimed in claim 1, wherein the lower rotating button has a location shaft formed on and protruding from the outer side of the lower rotating button;

the driving square-hole is formed through the location shaft and the sides of the lower rotating button;

the interior assembly has a middle board connected to the outer side of the inside mounting seat to cover the linking device between the inside mounting seat and the middle board, and the middle board has a length;

a lower end;

an upper end;

a lower guiding hole formed through the middle board near the lower end, mounted around the location shaft of the lower rotating button and aligning with the spring hole of the seat board;

a middle guiding hole formed through the middle board, mounted around the orientating shaft and aligning with the middle locating hole of the seat board; and an upper guiding hole formed through the middle board near the upper end and aligning with the upper locating hole of the seat board; and the seat board has a length longer than the length of the middle board.

3. The locking assembly as claimed in claim 2, wherein the transmitting device has a transmitting casing being rectangular, mounted on the inner side of the outside mounting seat and having a closed outer side mounted on the inner side of the outside mounting seat;

an open inner side;

a top;

a bottom;

two opposite sidewalls;

a width; and multiple holding claws respectively formed on and protruding from the opposite sidewalls of the transmitting casing around the open inner side; and a covering panel detachably connected to the transmitting casing to cover the open inner side of the transmitting casing and having a width being wider than the width of the transmitting casing;

a top;

a bottom, wherein the inner end of the press-button extends out the bottom of the covering panel;

multiple holding holes formed through the covering panel and respectively connected to the holding claws to hold the covering panel securely with the transmitting casing;

multiple fastener holes formed through the covering panel near the top and the bottom; and multiple fasteners mounted through the fastener holes and connected securely to the inner side of the outside mounting seat;

the button through hole is formed through the closed outer side and the bottom of the transmitting casing and aligns with the mounting hole;

the outer spindle hole is formed through the closed outer side of the transmitting casing above the button through hole;

the inner spindle hole is formed through the covering panel and aligns with the outer spindle hole of the transmitting casing; and the inner side of the engaging wheel is mounted in the inner spindle hole of the covering panel.

4. The locking assembly as claimed in claim 3, wherein the covering panel has two positioning holes formed through the covering panel beside the inner spindle hole;

the transmitting device has two lower supporting rods connected to the covering panel and each lower supporting rod having a diameter;

an outer end;

an inner end; and a positioning pin formed on and protruding from the outer end of the lower supporting rod, mounted in one of the positioning holes of the covering panel and each positioning pin having a diameter narrower than the diameter of the lower supporting rod;

the cylinder has two upper supporting rods connected to the inner side of the cylinder beside the cylinder-transmitting panel and extending through the door;

the seat board abuts the supporting rods of the transmitting device and the cylinder and has multiple through holes formed through the seat board and respectively aligning with the supporting rods of the transmitting device and the cylinder; and the interior assembly has multiple fastening bolts mounted through the through holes of the seat board and respectively and securely connected to the supporting rods of the transmitting device and the cylinder to hold the interior assembly with the cylinder and the exterior assembly.

5. The locking assembly as claimed in claim 4, wherein the outside mounting seat has two mounting bases formed on and protruding from the inner side of the outside mounting seat beside the mounting hole and each mounting base having a mounting recess facing the mounting hole;

a mounting pin mounted in the mounting recesses of the mounting bases the press-button has a pin hole formed through the press-button near the inner end and mounted around the mounting pin of the outside mounting seat; and the closed outer side of the transmitting casing covers the mounting recesses of the outside mounting seat to hold the mounting pin between the mounting bases and the transmitting casing.

6. The locking assembly as claimed in claim 5, wherein the outside mounting seat has a handle mounted on the outer side of the outside mounting seat near the lower end;

the transmitting board has a spring mount formed on the side of the transmitting board that adjacent to the rack near the top of the transmitting board; and the outside reset spring has two ends, one of ends of the outside reset spring abuts the top of the transmitting casing and the other end of the outside reset spring is mounted on the spring mount of the transmitting board.

7. The locking assembly as claimed in claim 1, wherein the transmitting device has a transmitting casing being rectangular, mounted on the inner side of the outside mounting seat and having a closed outer side mounted on the inner side of the outside mounting seat;

an open inner side;

a top;

a bottom;

two opposite sidewalls;

a width; and multiple holding claws respectively formed on and protruding from the opposite sidewalls of the transmitting casing around the open inner side; and a covering panel detachably connected to the transmitting casing to cover the open inner side of the transmitting casing and having a width being wider than the width of the transmitting casing;

a top;

a bottom, wherein the inner end of the press-button extends out the bottom of the covering panel;

multiple holding holes formed through the covering panel and respectively connected to the holding claws to hold the covering panel securely with the transmitting casing;

multiple fastener holes formed through the covering panel near the top and the bottom; and multiple fasteners mounted through the fastener holes and connected securely to the inner side of the outside mounting seat;

the button through hole is formed through the closed outer side and the bottom of the transmitting casing and aligns with the mounting hole;

the outer spindle hole is formed through the closed outer side of the transmitting casing above the button through hole;

the inner spindle hole is formed through the covering panel and aligns with the outer spindle hole of the transmitting casing; and the inner side of the engaging wheel is mounted in the inner spindle hole of the covering panel.

* * * * *